US007490730B2

(12) United States Patent
Cerone et al.

(10) Patent No.: US 7,490,730 B2
(45) Date of Patent: Feb. 17, 2009

(54) CONTAINER INCLUDING A SLIDER, A RECLOSABLE FASTENER AND A TRACK INCLUDING A RAMP

(75) Inventors: Daniel Raymond Cerone, West Chester, OH (US); Michael W. Negus, Elburn, IL (US); Hollis J. Habeger, Crete, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 769 days.

(21) Appl. No.: 09/996,663

(22) Filed: Nov. 29, 2001

(65) Prior Publication Data

US 2003/0098308 A1 May 29, 2003

(51) Int. Cl.
*B65D 45/00* (2006.01)
*B65D 8/18* (2006.01)
*B65D 43/14* (2006.01)

(52) U.S. Cl. ..... 220/315; 220/4.23; 220/833; 220/839

(58) Field of Classification Search ..... 220/315, 220/4.21, 4.22, 4.23, 833, 837, 839, 322; 383/63, 64; 24/399, 400, 387, 415
See application file for complete search history.

(56) References Cited

U.S. PATENT DOCUMENTS 2,629,911 A 3/1953 Macy
2,665,467 A 1/1954 Bosomworth et al.
2,736,079 A 2/1956 Staller et al.
2,756,172 A 7/1956 Kidd
2,972,792 A 2/1961 Johnson
3,660,875 A 5/1972 Gutman
3,784,055 A 1/1974 Anderson
3,967,756 A 7/1976 Barish
5,046,659 A * 9/1991 Warburton ..... 220/4.22
5,058,761 A * 10/1991 Williams ..... 220/833
5,062,186 A 11/1991 Rampolla et al.
5,189,764 A * 3/1993 Herrington et al. ..... 24/384

(Continued)

FOREIGN PATENT DOCUMENTS

BE 505325 9/1951

(Continued)

OTHER PUBLICATIONS

U.S. Appl. No. 09/755,408, filed Jan. 5, 2001, Robert I. Nurse.

(Continued)

*Primary Examiner*—Robin Hylton
(74) *Attorney, Agent, or Firm*—David K. Mattheis; Stephen T. Murphy; Leonard W. Lewis

(57) ABSTRACT

A container includes a container body, a cover, a reclosable fastener, a track, and a slider. The reclosable fastener is disposed between the container body and the cover and is adapted to fasten the cover to the container. The track includes a fastener portion formed on the reclosable fastener and a ramp. The ramp extends from a first end of the reclosable fastener and is at an angle with respect to a plane defined by the first end of the reclosable fastener. The slider is movable along the track to open or close the reclosable fastener.

20 Claims, 7 Drawing Sheets

U.S. PATENT DOCUMENTS

| | | | | |
|---|---|---|---|---|
| 5,636,783 | A | 6/1997 | Preston | |
| 5,662,758 | A | 9/1997 | Hamilton et al. | |
| 5,871,607 | A | 2/1999 | Hamilton et al. | |
| 5,965,235 | A | 10/1999 | McGuire et al. | |
| 6,092,687 | A * | 7/2000 | Hupp et al. | 220/666 |
| 6,194,062 | B1 | 2/2001 | Hamilton et al. | |
| 6,325,239 | B2 * | 12/2001 | Randall et al. | 220/835 |
| 6,394,299 | B1 * | 5/2002 | Hupp | 220/315 |
| 2001/0035423 | A1 | 11/2001 | Randall et al. | |
| 2002/0033396 | A1 * | 3/2002 | Hupp et al. | 220/315 |

FOREIGN PATENT DOCUMENTS

| | | | |
|---|---|---|---|
| EP | 1 138 608 | A | 10/2001 |
| GB | 387480 | | 2/1933 |
| WO | WO 00/64772 | A1 | 11/2000 |
| WO | WO 01 51361 | A | 7/2001 |
| WO | WO 01 51377 | A | 7/2001 |
| WO | WO 01 51378 | A | 7/2001 |

OTHER PUBLICATIONS

U.S. Appl. No. 09/480,974, filed Jan. 11, 2000, Matthew T. Hupp.
U.S. Appl. No. 09/480,976, filed Jan. 11, 2000, Matthew T. Hupp.
U.S. Appl. No. 09/997,108, filed Nov. 29, 2001, Hupp, et al.

* cited by examiner

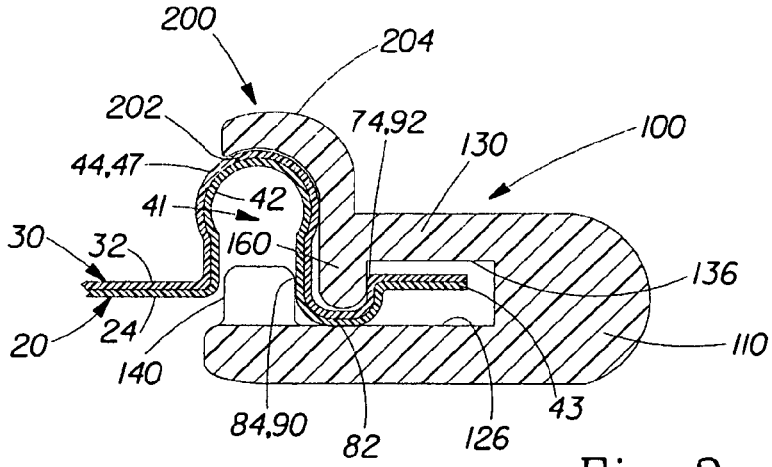
Fig. 2a
Fig. 2b
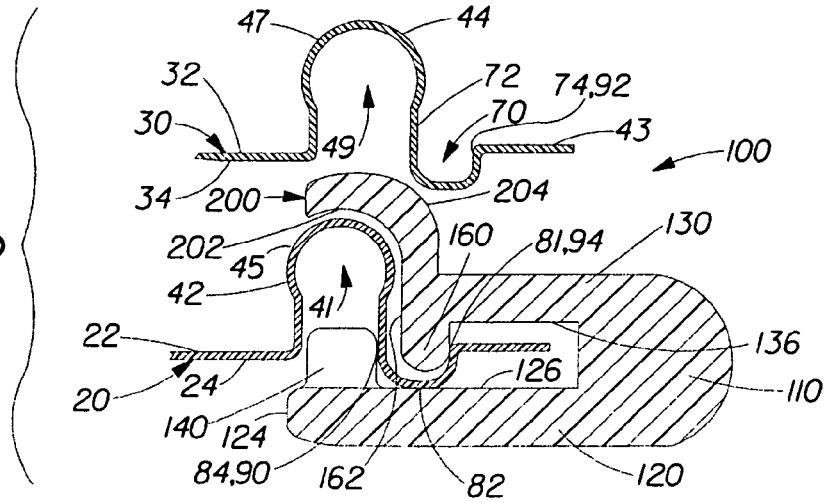

CONTAINER INCLUDING A SLIDER, A RECLOSABLE FASTENER AND A TRACK INCLUDING A RAMP

FIELD OF THE INVENTION

The invention relates to containers comprising a track including a ramp, a slider, and a rigid, elongate reclosable fastener, wherein the slider is movable along the track.

BACKGROUND

Flexible storage bags for use in the containment and protection of various items, as well as the preservation of perishable materials such as food items, are well known in the art. Such bags typically comprise an elongate reclosable fastener such as an interlocking rib-type seal integrally formed with the bag, to seal contents disposed in the bag. Sliding closure mechanisms, which utilize a sliding plastic sleeve to bias interlocking ribs into and out of engagement, have become popular due to their comparative ease of operation and visual and tactile confirmation that the seal formed by the reclosable fastener has been successfully completed.

Rigid and semi-rigid containers are also well known in the art. Such containers have realized a fair degree of commercial success in providing a means for storing a wide variety of contents. These containers typically incorporate lids which are usually sealed to the container by a reclosable fastener comprising interlocking protruded and recessed elements such as bulbs and grooves. Additionally, U.S. Pat. No. 3,784,055 issued Jan. 8, 1974 to Anderson, and U.S. Pat. No. 3,967,756 issued Jul. 6, 1976 to Barish, both of which are incorporated herein by reference, disclose containers utilizing plug seals.

While such mechanical closures can be effective in preserving container contents, some consumers experience difficulty in fully completing the closure operation and confirming for themselves that a satisfactory closure has been achieved. This is particularly so when the physical change in position of the cover between interlocked and non-interlocked positions is comparatively small.

Traditional sliders used with reclosable fasteners on flexible storage bags assure the user that the fastener is opened or closed during use, however, such sliders typically embody sidewalls limiting their operation to unidirectional fasteners. An example of a traditional type slider is illustrated in U.S. Pat. No. 3,660,875 issued May 9, 1972 to Gutman, and incorporated herein by reference. Since rigid and semi-rigid containers typically incorporate lids sealed by fasteners extending in multiple directions, the traditional sliders are unsuitable for opening or closing such fasteners.

Accordingly, it is desirable to provide containers including a slider for opening or closing a reclosable fastener wherein the slider is movable in multiple directions. Particularly, it is desirable to provide containers including a slider that is slidably attached to the reclosable fastener and capable of easily and effectively opening or closing the fastener and pivoting around corners. Further, it is desirable to provide containers including a slider having the aforementioned attributes that can effectively open and close the reclosable fastener requiring minimal maneuvering by the consumer other than moving the slider along the fastener. More particularly, it is desirable to provide a fastener that does not interfere with the normal operation and function of the container when not in use, but also interfaces easily with the reclosable fastener when in use.

SUMMARY OF THE INVENTION

In one embodiment, the invention is directed to a container which includes a container body, a cover, a reclosable fastener, a track comprising a ramp, and a slider. The reclosable fastener is disposed between the container body and the cover and is adapted to fasten the cover to the container. The track comprises a fastener portion formed on the reclosable fastener and a ramp. The ramp extends from a first end of the reclosable fastener and is at an angle with respect to a plane defined by the first end of the reclosable fastener. The slider is movable along the track to open or close the reclosable fastener. The ramp provides a parking location for the slider and can facilitate opening of the reclosable fastener.

In another embodiment, the invention is directed to a container comprising a cover extending in a two dimensional plane defining orthogonal X and Y directions, a container body, a reclosable fastener, a slider, and a ramp. The reclosable fastener is disposed between the cover and the container body and is adapted to fasten the cover to the container. The slider is slidably attachable to the reclosable fastener and movable along the reclosable fastener to open or close the reclosable fastener. The ramp extends from the reclosable fastener at an angle to the XY plane and provides a parking location for the slider.

In yet another embodiment, the invention is directed to a rigid, elongate reclosable fastener. The reclosable fastener comprises interlocking protruded and recessed portions, a slider, and a track for the slider. The track includes a fastener portion formed on at least one of the interlocking portions and a ramp extending from a first end of the interlocking portions. The ramp is at an angle with respect to a plane defined by the first end of the interlocking portions. The slider is movable along the track to open or close the interlocking portions.

The reclosable fasteners and containers according to the invention provide a convenient manner for opening and closing containers, and particularly the track ramp at one end of the fastener can facilitate opening of the reclosable fastener. These and additional advantages provided by the present invention will be more fully apparent in view of the following detailed description.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 2*a* is a cross sectional view of the opening end of the slider shown slidably attached to the reclosable fastener interlocking elements from the container depicted in FIG. 1*a* or 1*b* showing the interlocking elements in a closed configuration.

FIG. 2*b* is a cross sectional view of the opening end of the slider shown slidably attached to the elongate reclosable fastener depicted in FIG. 2*a* showing the interlocking elements separated in an open configuration.

DESCRIPTION

As used herein, the following terms have the following meanings:

X, Y, and Z are coordinates defining perpendicular directions intersecting one another at right angles at an origin. The X, Y, Z coordinates are defined at the first end of the reclosable fastener such that the X-Y plane corresponds to a plane defined by a first line drawn transverse to the flange slot and a second line drawn longintudinally with the flange slot. In preferred embodiments, the X-Y plane corresponds to the plane of the cover of the container.

Rigid means deficient or devoid of flexibility; appearing stiff and unyielding, remaining unaltered when typical in-use forces are applied.

A reclosable fastener is a fastener that is selectively openable and reopenable and, optionally, sealable and resealable.

The present invention pertains to a container having a track comprising a ramp, and a slider suitable for opening or closing an elongate rigid reclosable fastener. The container of the present invention includes a rigid, elongate reclosable fastener; a slider; and a track for the slider. Particularly, the track extends in the closing direction, beyond the reclosable fastener along the ramp.

Figure 1A:
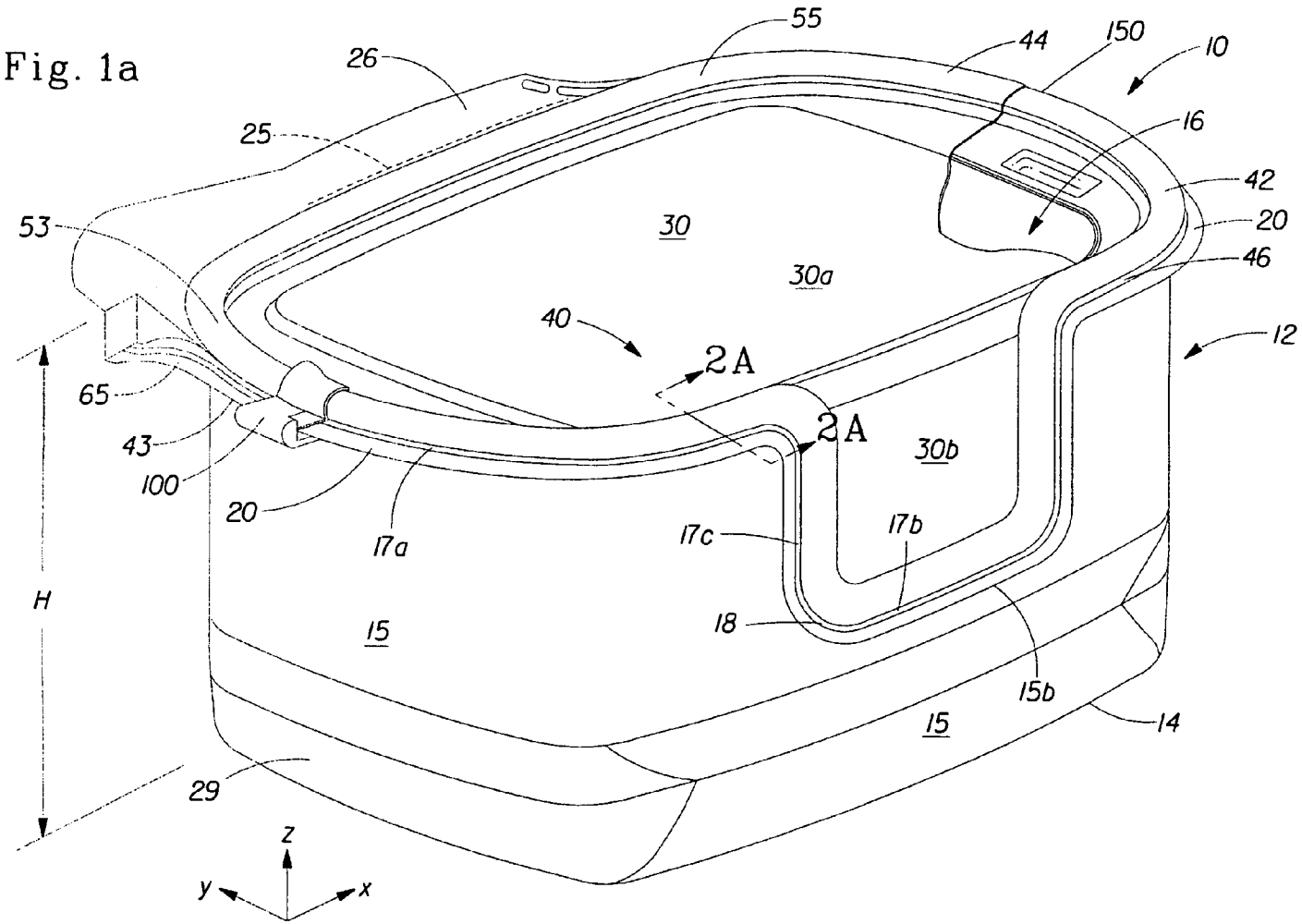
FIG. 1*a* is a perspective view of a first embodiment of a container according to the invention incorporating a track including a ramp and a slider for facilitating the opening or closing of a reclosable fastener to detach a cover from a container body.

The containers according to the present invention are suitable for opening or closing a rigid, elongated reclosable fastener and a slider, wherein the slider travels in a track lying along a path of travel. The reclosable fastener is closable or fastenable, optionally sealable, in a direction orthogonal to the travel path, whereby, as the slider moves along the track, the slider imparts forces to the fastener in an orthogonal direction to open or close the fastener. The ramp is provided, among other things, to improve the ability of the slider to interface with the fastener in order to open the container. In FIG. 1*a* an example of such a reclosable fastener 40 is shown fastening or sealing a cover 30 to the flange 20 on a body of a container 10 having an ascent or ramp 65.

The container 10 according to the present invention and as depicted in FIG. 1*a* may be relatively small, such that the container 10 may be stored in one's pocket or purse. Such a container 10 may be useful for storing pills, capsules, etc. Alternatively, the container 10 may be relatively large such that the container 10 is sized to fit a flat bed semi-truck. Such a container 10 may be useful for carrying construction materials, etc. One contemplated use for the container 10 is to store perishable items such as food.

In the embodiment depicted in FIG. 1*a*, the storage container 10 includes a container body 12 which may be unitarily formed from a piece of sheet material. The container body 12 may have a planar or domed shaped bottom side 14, an opening 16, four sidewalls 15, and a flange 20 circumscribing the opening 16. The container 10 also includes a cover 30 for covering the opening 16. In one embodiment, the top edges of all the sidewalls lie in a single plane about the perimeter of the container. In an alternative embodiment as shown in FIG. 1*a*, the top edges or portions of the edges 15*a* and 15*b* of the four sidewalls 15 do not all lie in a single plane. These edges, 15*a* and 15*b*, partially define the perimeter of the container opening. The container perimeter may also be round, oval, polygonal or any other configuration as would be obvious to one skilled in the art. The cover 30 may be extend in one plane or, as shown in FIG. 1*a*, at least two planes to cover the opening 16 about the perimeter of the container. In FIG. 1*a* the cover 30 is illustrated as having two substantially perpendicular surfaces: a top portion 30*a* and a side portion 30*b*. The flange 20 on the container body 12 aligns with the perimeter of the cover 30. The flange 20 and the cover 30 may be shaped concave and/or convex relative to the bottom side 14 and/or the respective opposing sidewalls.

Figure 1B:
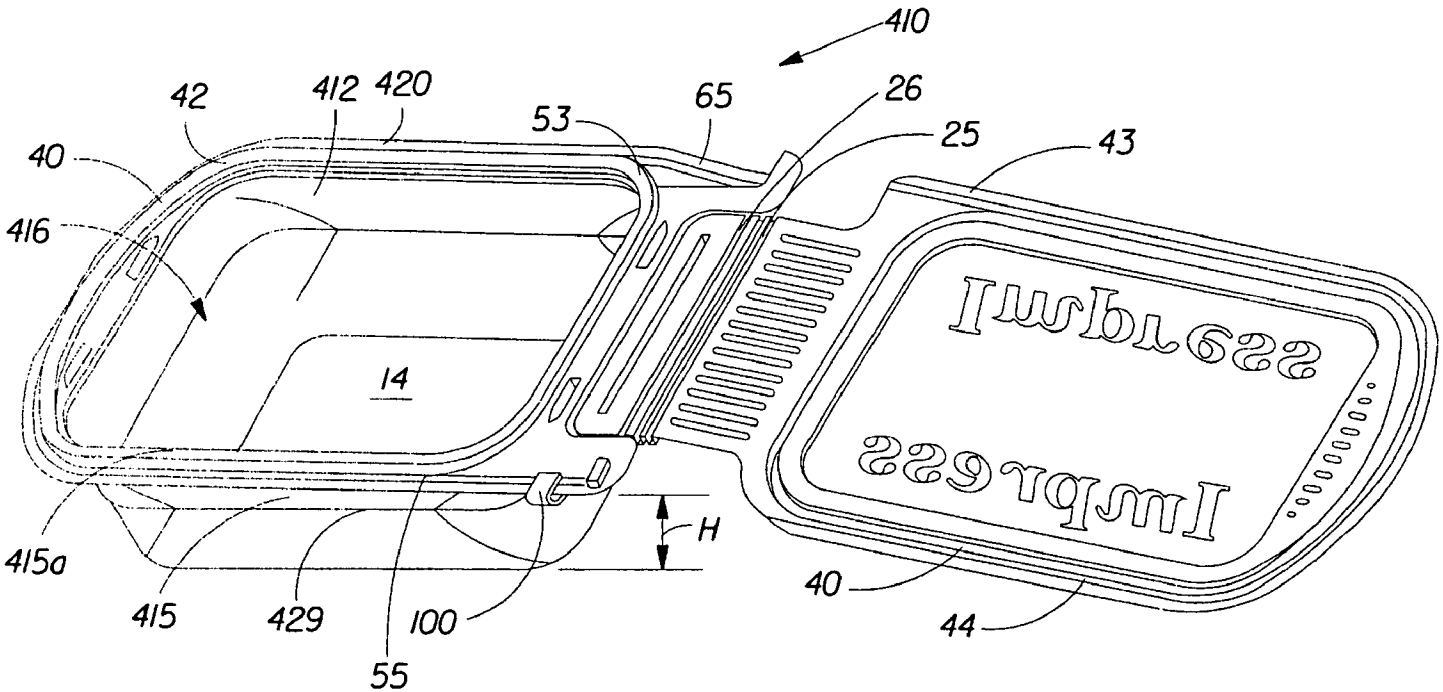
FIG. 1*b* is a perspective view of a second embodiment of a container according to the invention incorporating a track including a ramp and a slider for facilitating the opening or closing of a reclosable fastener to detach a cover from a container body.

In another embodiment and as depicted in FIG. 1*b*, the storage container 410 includes a container body 412 which may also be unitarily formed from a piece of sheet material. The container body 412 may have a planar or domed shaped bottom side 414, an opening 416, four sidewalls 415, and a flange 420 circumscribing the opening 416. The container 410 also includes a cover 430 for covering the opening 416. The edges 415*a* of the sidewalls 415 define the perimeter of the container opening 416. In this embodiment, the top edges 415*a* of all the sidewalls 415 lie in a single plane. The container perimeter may also be round, oval, or polygonal as would be obvious to one skilled in the art. The cover 430 extends in one plane. The flange 420 on the container body 412 aligns with the perimeter of the cover 430. The flange 420 and the cover 430 may be shaped concave and/or convex relative to the bottom side 414 and/or the respective opposing sidewalls 415.

Various compositions suitable for constructing the containers 10 of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a low density polyethylene film, 10 mil (0.25 millimeters) thickness, commercially available from Chevron under the manufacturer's designation PE1122 or syndiotactic polypropylene available from Fina Corp. under the designation EOD96-28 of 20 mil (0.5 millimeters) thickness. Further suitable materials include a polyethylene/polypropylene blend. Wood and metal may be used for larger size containers 10.

Although the container bodies 12 and 412 illustrated in FIGS. 1*a* and 1*b*, respectively, have four sidewalls, the container body may actually comprise three or more sidewalls. In addition, although the opening 16 in the container illustrated in FIG. 1*a* is disposed partially opposite the bottom side 14, the invention is applicable to openings disposed fully opposite the bottom side as shown in FIG. 1*b* or on any side or sides of the container.

As seen in FIGS. 1*a* and 1*b*, the flange 20, or 420 may be either unitarily formed with the container body 12, or 412 or provided as a separate material joined to the container body. When provided as a separate, preferably more rigid material element, it is preferred that the remainder of the container body material be formed into at least a small peripheral flange at its upper edge (defining the opening 16, or 416) with pleated corners so as to form a suitable junction point for joining the container body to the flange. The cover 30, or 430 may be either unitarily formed with the container body or at least hingedly attached to the flange at a hinge line 25 of a hinge 26. As shown in FIG. 1*a*, the hinge 26 may comprise a unitary living hinge or be provided as a line of weakness by scoring, perforations, or the like which may optionally permit the cover 30 to be separated from the container body 12. While a hinged embodiment is shown, embodiments without hinges are contemplated.

The reclosable fastener 40 may circumscribe or partially enclose the container opening 16. The reclosable fastener 40 may comprise any type of reusable mechanical fastener or seal known in the art. It is preferred that the reclosable fastener provides a liquid impervious seal, although non-sealing reclosable fasteners are also contemplated. Suitable seals include for example friction fit seals, compression fit fin seals, adhesive seals, cohesive seals, and selectively activatable adhesives as illustrated by commonly assigned U.S. Pat. No. 5,662,758, issued Oct. 2, 1997 in the names of Hamilton et al.; U.S. Pat. No. 5,871,067, issued Feb. 16, 1999 in the names of Hamilton et al.; U.S. Pat. No. 5,965,235, issued Oct. 12, 199 in the names of McGuire et al.; and U.S. Pat. No. 6,194,062, issued Feb. 27, 2001 in the name of Hamilton et al., all of which are incorporated herein by reference. By reusable, it is meant that the cover 30 of the container 10 may be reversibly transformed between each of the open and closed positions at least two times and still functionally fasten or seal the container 10.

In one embodiment and as shown in FIGS. 1*a* and 1*b*, the reclosable fastener 40 comprises mechanical interlocking elements 42 and 44 in which at least one protruded element 42 interlocks with at least one recessed element 44 to form a seal. As depicted in FIG. 1*a*, the two interlocking elements 42 and 44 circumscribe the container opening 16, occupying a marginal portion of the cover 30 and a marginal portion of the flange 20. The interlocking elements 42 and 44 are preferably spaced a substantially constant distance inwardly from the peripheral edge of the cover 30 and flange 20 enabling a slider 100, having an adequate inward extent, to be drawn along a track 46 at the peripheral edge without leaving gaps or unsealed portions.

Also shown in FIG. 1*a*, the container body may optionally include a collapsible portion 29. The collapsible portion 29 may conveniently be collapsed to decrease the need for storage space and extended to increase the volume of the storage volume inside the container. In one embodiment, the container 10 has a height, H. The travel path may extend along the sides of the container for a distance less than the height H of the container, such as shown in FIG. 1*a*. In such an embodiment, the collapsible portion 29 is limited to a height below the track.

In an alternative embodiment of the current invention such as shown in FIG. 1*b*, the container 410 has a two dimensional cover 430 lying substantially in an XY plane. In this embodiment, the collapsible portion 429 may extend along substantially the entire container body height H. Thus, a container which may be collapsed more completely can be achieved.

As illustrated in FIGS. 2*a* and 2*b*, the protruded element 42 may have a bulbous shape and the recessed element 44 may comprise a groove 49 shaped complementary to the protruded element 42. The interlocking elements 42, 44 of the reclosable fastener 40 are disposed on mating portions of the flange 20 and cover 30, respectively. The protruded element 42 may be unitarily formed with the flange 20 extending upwardly from the top side 22 of the flange 20 while the recessed element 44 may be uniformly formed with the cover 30 having a bulbous non-interlocking surface 47 extending upward from the top side 32 of the cover 30 or vice versa. The recessed element 44 is open on the bottom side 34 of the cover 30 so as to receive the protruded element 42 therein while the protruded element 42 is open at open end 41 on the bottom side 24 of the flange 20.

The slider 100, as depicted in FIGS. 2*a*, and 2*b*, has a generally C-shaped configuration with ends of the slider 100 straddling the peripheral edges of the flange 20 and cover 30 enabling portions of the slider 100 to interface with the interlocking elements 42 and 44 of the reclosable fastener 40. One portion of the slider 100 which interfaces with interlocking elements 42 and 44 has a spacing therebetween which is sufficiently small as to bias the elements into interlocking engagement when the slider 100 is translationally drawn in a first direction over a region of the periphery where the elements are separated. As depicted in FIG. 2*b*, other portions of the slider 100 urge the interlocked elements 42 and 44 apart as the slider 100 moves in a second direction opposite the first direction, applying separating forces.

The container includes a track which defines a travel path. As shown in FIG. 1*a*, the track 46 extends at least from a first end 53 of the reclosable fastener 40 to a second end 55 of the reclosable fastener 40 for directing the motion of the slider 100 along the fastener 40. In FIG. 1*a*, at least a portion of the track 46 is disposed congruent with the reclosable fastener 40.

Figure 3:
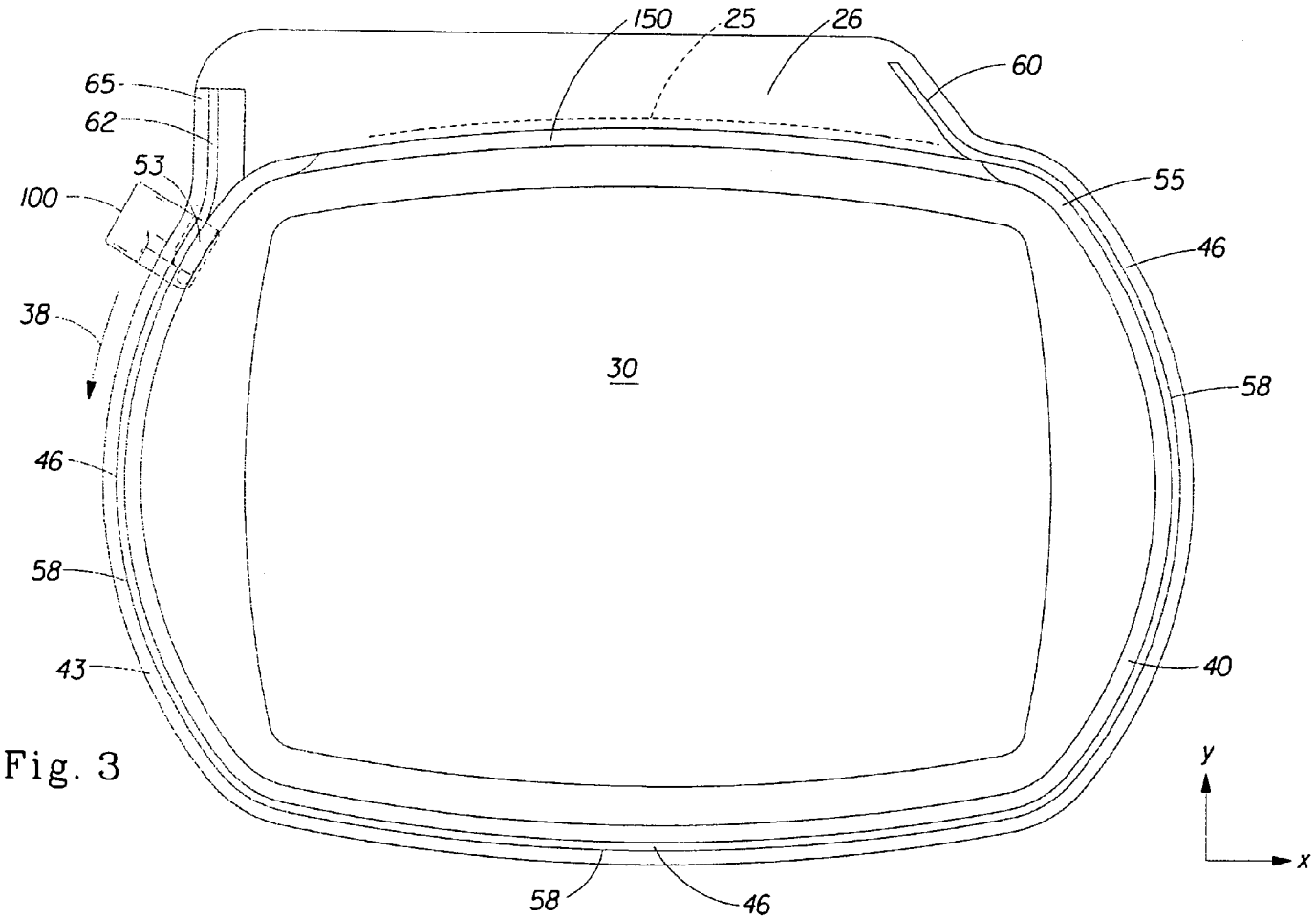
FIG. 3 is a top view of the container depicted in FIG. 1*a* showing the travel path of the slider in a first direction of travel which closes the reclosable fastener.
Figure 4:
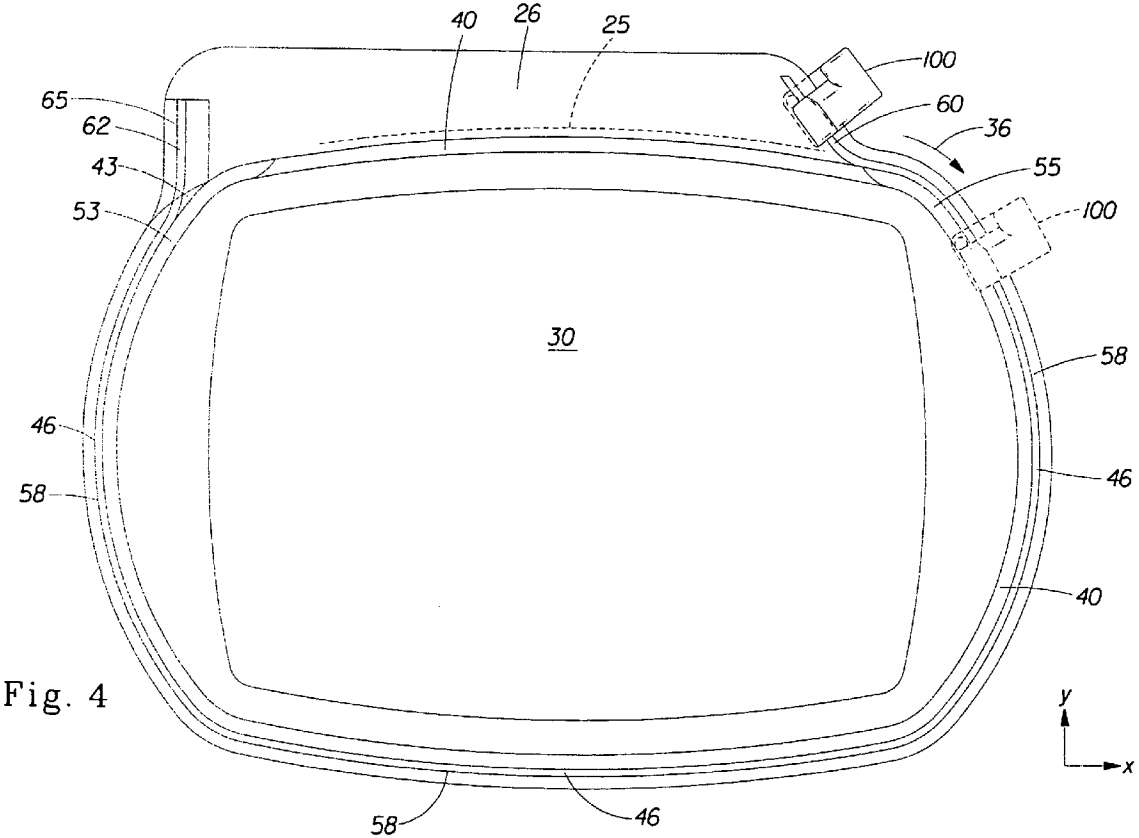
FIG. 4 is a top view of the container depicted in FIG. 1*a* showing the travel path of the slider in a second direction of travel which opens the reclosable fastener.

FIGS. 3 and 4 (differing only by the location of the slider 100) show top views of the container 10 depicted in FIG. 1*a*. The track 46 is congruent with the reclosable fastener 40 along the edges of the cover 30 and flange of the container body 12 (not shown), except at the edges occupied by the hinge line 25. The track 46 has a fastening portion 58 that runs congruent with, or is part of, the reclosable fastener 40. In other words, the fastening portion 58 of the track 46 runs from the first end 53 of the reclosable fastener 40 at one side of the hinge line 25, to the second end 55 of the reclosable fastener 40 at the other side of the hinge line 25. The fastening portion 58 is aligned along the perimeter of the container at three of the four sidewalls (shown as 15 and 415 in FIG. 1*a* and 1*b*, repectively). The fastening portion 58 of the track 46 does not extend along the hinge line 25. In other embodiments, the container perimeter can be round, oval, or polygonal and would typically have a fastening portion 58 of the track 46 along a substantial portion of the perimeter but not along the perimeter at the hinge line 25.

As can be seen in FIG. 3, moving in a closing direction 36, as the track 46 approaches the first end 53 of the fastener 40 near the hinge line 25, the track 46 diverts away from the fastener 40 in order to direct the slider 100 to the ramp 65 for parking the slider 100. As can be seen in FIG. 4, moving in a opening direction 38, as the track 46 approaches the second end 55 of the reclosable fastener 40 near the hinge line 25, the track 46 diverts away from the fastener in order to direct the slider 100 to a second auxiliary track 60 for parking the slider 100. The auxiliary tracks and/or ramp enable the cover 30 to rotate about the hinge line 25 or to be removed from the container without interference from the slider 100.

In one embodiment and as illustrated in FIGS. 2*a*, the track may comprise a slot 70 in the top side of the cover 30 congruent with the recessed element 44 of the reclosable fastener 40. The cover slot 70 includes an inside edge 72 nearest the recessed element 44 and an outside edge 74 opposite the inside edge 72. The cover slot 70 in the top side 32 of the cover 30 forms a bead 76 on the bottom side 34 of the cover 30 which interfaces with a complementary flange slot 80 in the top side 22 of the flange 20 congruent with the protruded element 42 of the reclosable fastener 40. The flange slot 80 in the top side 22 of the flange 20 protrudes through the flange 20 forming a bead 82 on the bottom side 24 of the flange 20. The bead 82 on the bottom side 24 of the flange 20 includes an inside edge 84 nearest to the opened end 41 of the protruded element 42 and an outside edge 86 opposite the inside edge 84. The track may be defined, at least partially, as the cover slot 70 when the slider is moved in the closing or first direction 36. The track 46 may also be partially defined as the flange slot 80 when the slider is moved in the opening or second direction 38.

Figure 6A:
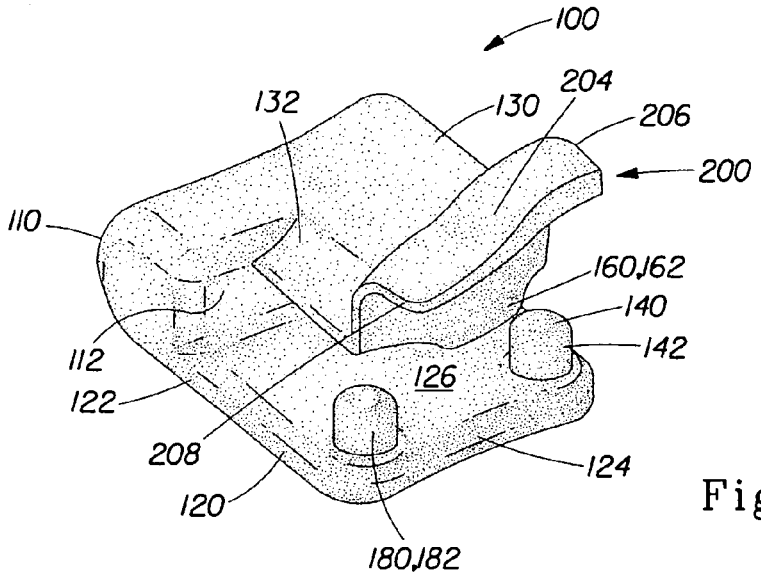
FIG. 6*a* is a perspective view of a slider used in one embodiment of the container of the present invention.
Figure 6B:
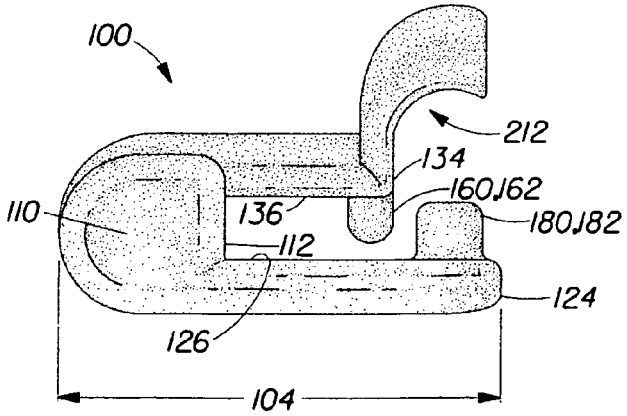
FIG. 6*b* is an end view of the closing side of the slider of FIG. 6*a*.
Figure 6C:
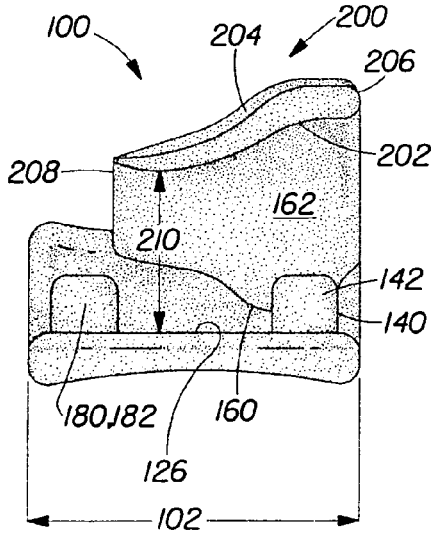
FIG. 6*c* is an end view of the opening side of the slider of FIG. 6*a*.

As illustrated in FIGS. 3 and 4, the slider 100 is slidably attached to the track 46 and may be moved along the travel path defined by the track 46. FIGS. 6*a*, 6*b*, and 6*c* also show one exemplary embodiment of a slider 100 having a width "W" running substantially orthogonal to the track 46. The C-shaped body of the slider 100 comprises a base 110 having a first surface 112 with first and second elongate members 120, 130 extending therefrom in a side-by-side arrangement. The first elongate member 120 includes a pivot 140 depending from the internal surface 126 and projecting towards the second elongate member 130. The second elongate member 130 includes a tracking member 160 depending from the internal surface 136 and projecting towards the first elongate member 120. At the end opposite the base 110, the second elongate member includes a wedge 200.

The tracking member 160 may be aligned with the pivot 140 along the length and along width of the slider 100. Alternatively, the tracking member 160 may be offset from the pivot 140 along the length and width of the slider 100. Preferably, as shown in FIGS. 6*a*, 6*b*, and 6*c*, the tracking member 160 is offset from the pivot 140 along the width of the slider 100 and aligned with the pivot 140 along the length of the slider 100.

In FIG. 6*a*, the first and second elongate members 120, 130 straddle the peripheral edges of the cover 30 and flange 20 while the pivot 140 and tracking member 160 interface with the interlocking elements of the fastener 42 and 44. The tracking member 160 interfaces with the non-interlocking surface 47 at the cover slot 70 of the cover 30 for closing the fastener 40. In FIG. 6*b*, the pivot 140 interfaces with the open end 41 of the protruded element 42 on the bottom side 24 of the flange 20 for opening the fastener 40.

The sliders employed in the containers according to the present invention are preferably injection molded from high density polyethylene. However, one skilled in the art would recognize that such sliders may be manufactured from any moldable or machinable material utilizing machining or molding operations known in the art.

Figure 5A:
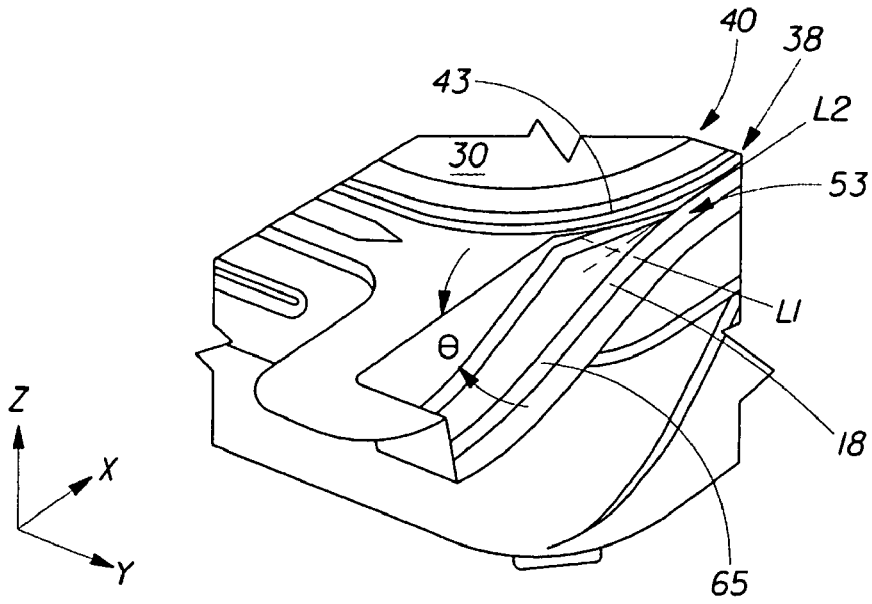
FIG. 5*a* is a cutout of the perspective view depicted in FIG. 1*b* showing the relationship between the ramp and the reclosable fastener.

As depicted in FIGS. 1*a* and 1*b*, the ramp 65 is provided at the first end 53 of the reclosable fastener 40. As depicted in FIG. 5*a* (a cutout view of FIG. 1*b*), the ramp 65 is not only divergent from the reclosable fastener 40, the ramp is also at an angle θ with respect to an X-Y plane. The X-Y plane is defined at the first end 53 of the reclosable fastener. More specifically, the X-Y plane may be defined as the plane defined by two lines, the first line $L_1$ being drawn transverse to the flange slot 80, where the track 46 first diverges from the reclosable fastener 40, and the second line $L_2$ being drawn longitudinally with the flange slot 80 (in the direction of the travel path) from where the track 46 first diverges from the reclosable fastener 40. Since the ramp 65 is positioned at an angle θ with respect to this XY plane, the ramp 65 has a Z-direction vector component. Thus, the slider moves three dimensionally.

The slider (not shown in FIGS. 5*a* and 5*b*) may typically be parked at the ramp 65 when the cover is in the closed position. When moving the slider along the ramp 65 toward the first end 53 of the reclosable fastener 40, the leading edge of the slider may contact the flexible lip 43 of the cover 30 to begin opening of the fastener. The ramp 65, at an angle θ with respect to the first end 53 of the fastener 40, allows a leading edge of the slider to easily be engaged between the interlocking elements (42 and 44 in FIGS. 1*a* and 1*b*) of the fastener 40 to initiate the opening of the fastener 40. The positioning of the ramp 65 at an angle θ with respect to the first end 53 is advantageous because the flexible lip 43 of the cover 30 does not have to be specially adapted to receive the slider, thus the flexible lip 43 may remain similar, typically flat, around the perimeter of the container 10. This may facilitate both manufacturing and opening of the container.

Figure 5B:
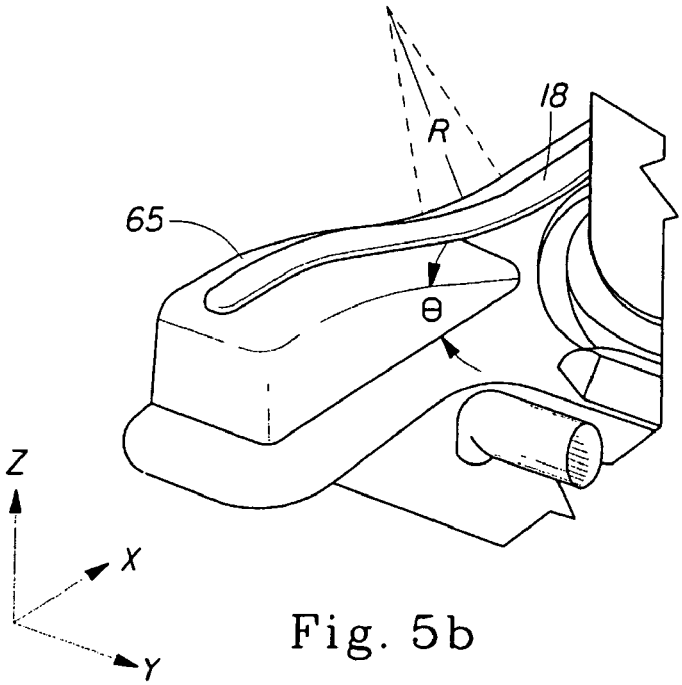
FIG. 5*b* is a perspective view of the bottom side of the cutout view in FIG. 5*a*.

While various configurations of the ramp 65 may be contemplated, in one embodiment and as shown in FIG. 5*b*, the ramp 65 may have an arc 18 defined by a radius R, generally in the Z-direction, at the transition between the reclosable fastener 40 and the ramp 65. The radius R is based on the size of the container, the size of the seal bead, and the material used to make the container. The radius R may turn or angle the track 46 in the Z-direction from an X-Y plane at an angle at least sufficiently steep to allow the slider to come underneath the flexible lip 43 of the cover 30. The ramp 65 may extend linearly at a distance at least long enough to allow the slider to be in the closed position without interfering with the hinge or flexible lip.

While a ramp 65 having a linear extension from the plane of the reclosable fastener first end 53 is depicted, more complex arrangements are contemplated. In other embodiments, the ramp may include a three dimensional curved portion or portions. Such arrangements may create a corkscrew like affect. In other embodiments, the linear extension may also be curvilinear or otherwise configured for aesthetics or practical reasons such as allowing the slider to be hidden under the hinge or the flange of the container.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising (a) a container body comprising a first fastener portion;

(b) a cover comprising a second fastener portion adapted to engage the first fastener portion to form a reclosable fastener having a first end and a second end, wherein the cover defines an X-Y plane when the first fastener portion and second fastener portion are engaged;

(c) a track comprising a track fastener portion formed on the reclosable fastener and a ramp extending from the X-Y plane; and (d) a slider movable along the track to open or close the reclosable fastener.

2. The container according to claim 1, wherein the slider is movable in the track in a closing direction from the second end of the reclosable fastener to the first end of the reclosable fastener and is movable in the track in an opening direction from the first end of the reclosable fastener to the second end of the reclosable fastener.

3. The container according to claim 2, wherein the ramp is adapted for parking the slider after closing the reclosable fastener.

4. The container according to claim 2, wherein the track further comprises an auxiliary track extending from the second end of the reclosable fastener and adapted for parking the slider after opening the reclosable fastener.

5. The container according to claim 1, wherein the slider has a leading edge in the opening direction, the leading edge adapted to engage the cover at about the first end of the reclosable fastener to open the container.

6. The container according to claim 1, wherein the cover comprises a flexible lip extending from the reclosable fastener.

7. The container according to claim 6, wherein the slider is adapted to engage the flexible lip at about the first end of the fastener to initiate opening of the reclosable fastener.

8. The container according to claim 7, wherein the slider engages an underneath side of the flexible lip forcing the cover to separate from the container body.

9. The container according to claim 6, wherein the ramp and the first end of the reclosable fastener define an angle therebetween, the angle sufficiently steep to allow the slider to engage the flexible lip at about the first end of the fastener to initiate opening of the reclosable fastener.

10. The container according to claim 9, wherein the angle is an acute angle.

11. The container according to claim 1, wherein the reclosable fastener comprises interlocking protruded and recessed elements, the protruded element is provided on the container body and the recessed element is provided on the cover.

12. The container according to claim 1, wherein the ramp has a radius of curvation at about the first end of the fastener.

13. The container according to claim 1, wherein the ramp extends linearly for a distance to allow the slider to be parked without interfering with the cover.

14. The container according to claim 1, wherein the reclosable fastener is sealable.

15. The container according to claim 1, wherein the reclosable fastener is adapted to fasten the cover around at least a portion of a perimeter of the container.

16. The container according to claim 15, wherein the portion of the perimeter defines a single plane.

17. The container according to claim 15, wherein the portion of the perimeter defines more than one plane.

18. A container comprising:

a cover comprising a first fastener portion, a container body comprising a second fastener portion adapted to engage the first fastener portion to form a reclosable fastener having a first end and a second end, wherein the cover defines an X-Y plane when the first fastener portion and second fastener portion are engaged;

a slider slidably attached to the reclosable fastener and movable along the reclosable fastener to open or close the reclosable fastener; and a ramp extending from the reclosable fastener at an angle to the XY plane and providing a parking location for the slider.

19. A rigid elongate reclosable fastener comprising interlocking protruded and recessed portions, the fastener defining a plane comprising orthogonal X and Y dimensions when the portions are interlocked, a slider, and a track for the slider, the track including a fastener portion formed on at least one of the interlocking portions and a ramp extending from a first end of the interlocking portions at an angle to the X-Y plane, wherein the slider is moved along the track to open or close the interlocking portions.

20. The container according to claim 6, wherein the ramp and the first end of the reclosable fastener define an angle therebetween, the angle sufficiently steep to allow the slider to initiate opening of the reclosable fastener.

* * * * *